United States Patent [19]

Foody

[11] 4,281,490

[45] Aug. 4, 1981

[54] SILO

[76] Inventor: Patrick Foody, 280 Main Rd., Hudson, Quebec, Canada

[21] Appl. No.: 47,948

[22] Filed: Jun. 12, 1979

Related U.S. Application Data

[63] Continuation-in-part of Ser. No. 914,043, Jun. 9, 1978, abandoned.

[51] Int. Cl.[3] ..... E04H 7/22

[52] U.S. Cl. ..... 52/236.1; 52/259

[58] Field of Search ..... 52/234, 73, 236.1, 259, 52/236.9, 79.9

[56] References Cited

U.S. PATENT DOCUMENTS

| | | | |
|---|---|---|---|
| 3,373,536 | 3/1968 | Reimbert | 52/234 |
| 4,077,174 | 3/1978 | Leaumont | 52/259 |

FOREIGN PATENT DOCUMENTS

| | | | |
|---|---|---|---|
| 548502 | 6/1956 | Belgium | 52/259 |
| 2529506 | 1/1977 | Fed. Rep. of Germany | 52/259 |

*Primary Examiner*—John E. Murtagh

*Attorney, Agent, or Firm*—Stevens, Davis, Miller & Mosher

[57] ABSTRACT

A multi-cell silo structure includes an array of vertical reinforced concrete columns. Planar diaphragm panels of either reinforced concrete or steel extend between the columns and define the walls of the cells. The panels are connected to the columns such that vertical loadings on the panels are transmitted laterally to the columns, such loadings then passing down the columns to the silo foundations.

9 Claims, 16 Drawing Figures

SILO

This is a continuation-in-part of my co-pending application Ser. No. 914,043 filed June 9, 1978, now abandoned.

This invention relates to storage silos, and particularly to silos having a plurality of vertically-arranged cells for the storage of grain and other forms of particulate materials.

Multi-celled silo structures are very well known in the art. These structures must, of course, be designed to meet the particular conditions encountered in storing a relatively tall column of particulate material, such as grain. It is well known that such materials, in contrast to liquid materials, exert a substantial downward or vertical thrust component on the walls of the silo structure in addition to the usual laterally directed forces.

Silo structures made entirely of steel are well known. However, steel structures and prone to crippling due to the relatively high axial loadings involved. Large diameter smooth walled steel tanks have been designed which incorporate vertical load bearing columns. These columns have the effect of reducing the "slenderness ratio" of a structure and they are designed to take only a part of the vertical loading with the steel side walls taking the majority of the vertical loading and transmitting same to the silo foundations.

The most widely known form of silo structure is made of reinforced concrete. Such structures are commonly built with the use of "slip-form" continuous concrete pouring techniques. This form of construction provides reasonably good results from the technical point of view but there is a problem insofar as manpower and construction costs are concerned. A large multi-celled grain storage silo may require a work crew of up to about two hundred men but since the entire job may occupy only a period of about two weeks there is obviously quite often a serious problem in hiring and accommodating such a large group of men for a short-term period. In addition, in the slip-form construction technique the labour costs tend to be very high since work is carried on in a continuous fashion and substantial overtime costs, e.g. for night work, are involved.

A further disadvantage of conventional reinforced concrete construction techniques is that the initial cost of setting up a slip-form system is very high. Thus, it is not generally economical to build relatively low silos using these techniques. The system only becomes economical when very high silos are involved, it being kept in mind that the cost of the initial setup does not vary appreciably with the height of the silo structure being erected. A further disadvantage of conventional slip-forming techniques is that the minimum practical wall thickness is about seven inches. If the wall thickness is appreciably less than seven inches, the vertical friction forces imposed on the wall by the rising slip-form may exceed somewhat the weight of the concrete wall, thus causing the wall being formed to be lifted upwardly slightly during construction thus resulting in cracks and other defects. Thus the minimum wall thickness permissible using conventional slip-forming techniques is often substantially greater than the minimum wall thickness necessary having regard to the loads and stresses involved during normal use of the completed structure.

Certain other silo systems have been designed which employ pre-cast concrete panels. However, in cases where these panels are stacked one above the other, such that horizontal load-bearing joints are disposed therebetween, problems often arise as the result of stress concentrations along such load-bearing joints. It is difficult to obtain a near perfect fit at the load-bearing joints; thus, if stress concentrations are to be avoided, careful grouting of the joints is necessary to provide uniform stress distribution. In addition, many of the prior art systems tended to be very inflexible insofar as their use of materials was concerned. In certain countries, steel is the preferred material of construction by virtue of its ready availability and low cost. In other countries or regions of a particular country, concrete is the preferred material in terms of its availability and cost. Present designs do not permit any degree of flexibility insofar as the selection of materials is concerned. Those skilled in the art will recognize the desirability of a design which will permit the major use of either steel or concrete as one of the major structural components depending upon cost and availability.

It is a primary objective of the present invention to provide a silo construction capable of alleviating the various disadvantages and problems noted above.

Thus, in accordance with the present invention in one aspect there is provided a silo having a plurality of vertically arranged cells for the storage of particulate materials, said silo comprising: a foundation, a plurality of spaced apart rigid vertical columns of reinforced cast-in-place concrete supported by said foundation, each column including a plurality of integral load bearing longitudinally extending webs radiating outwardly therefrom and being generally co-extensive therewith with each web extending in a direction toward a respective one of the webs of the columns next adjacent thereto, such that each of the webs of each column is disposed in opposed, horizontally spaced relationship with an associated one of the webs of one of the next adjacent columns, each such web terminating along a vertically disposed marginal edge, a plurality of vertically disposed diaphragm panel structures, each of which extends between the vertically disposed marginal edges of a respectively associated one of the web pairs, each diaphragm panel structure having a pair of vertically directed marginal sides each of which is connected in abutting relation to a respective one of the vertically disposed marginal edges of the associated web pairs in such a manner that vertically directed thrust components applied to the diaphragm panel structures are transmitted laterally to the marginal edges of said load bearing webs so that the resulting vertical loadings are transmitted to the silo foundation via the vertical columns, the webs of the columns and the associated diaphragm panel structures being constructed and arranged to withstand laterally directed forces applied thereto, in use, by the materials stored in the silo, and said columns being located in a pre-selected array such that said columns and the diaphragm panel structure associated therewith define an array of adjacent vertically arranged storage cells.

In accordance with a further feature of the invention, each diaphragm panel structure comprises a plurality of panel sections in superposed relation to one another with generally horizontally disposed joints being defined between adjacent panel sections, each panel section being adapted to transfer the vertically directed thrust components thereon to its marginal edges, each panel section including a plurality of laterally elongated elements which extend into the associated webs of the reinforced concrete columns to provide said connection and structural continuity between said webs and the panel sections and to assist in providing said webs with the necessary structural strength to withstand the bending moments encountered during use.

In a typical form of the invention shear force transmitting means are arranged to interact between the abutting marginal sides of the panel structures and the marginal edges of the webs whereby to transmit the vertically directed thrust components from the panel structures to the webs of their associated vertical columns.

In a typical embodiment of the invention each vertical column is of reinforced concrete construction. These columns are poured on the site, i.e. the concrete is "cast in place". On the other hand, the diaphragm panel sections are typically prefabricated. In one embodiment of the invention, each diaphragm panel section comprises a slab of reinforced concrete. In another embodiment of the invention each panel section comprises a metal panel having generally horizontally disposed corrugations therein to withstand the laterally directed forces which are encountered during use.

The columns, their integrally formed webs, and the associated panel structures may be arranged to provide a plurality of cells nesting with each other in the form of a honeycomb, e.g., such that each cell has a hexagonal outline in plan. Octagonal shapes may also be provided. Alternatively, the layout may be such as to provide cells having a rectangular outline shape in plan.

The above described construction may be erected with the use of only a relatively small number of personnel. There is no need to hire a very large work force as in the case of a typical slip-forming operation since the column forms can be set up and the pre-formed diaphragm panels set in place and the columns poured with the use of only a relatively small number of men. The construction work need not be carried out continuously thus facilitating orderly scheduling of the work crew and eliminating the need for overtime work at elevated hourly wage rates. The initial setup costs in terms of the form work required is relatively small as compared with the conventional slip-forming setup so it is economical to produce silos in the low to moderate height range (it being understood that the silos can, of course, be constructed to any reasonable height utilizing the principles of the present invention).

Another feature of the invention is that the diaphragm panel structure need not carry any significant vertical loadings since, in accordance with one feature of the invention, the vertical thrust components applied to the diaphragm panels are transmitted outwardly to the webs of the columns with the columns bearing virtually all the vertical loadings. This feature is of particular importance in relatively high silos since it eliminates the problems associated with horizontal load bearing joints. Furthermore, it makes possible the use of steel diaphragm panels which are not, in any event, capable of sustaining substantial vertical loadings. However, it should be noted that in relatively low silos, provision may be made for the diaphragm panels (particularly reinforced concrete panels) to carry a certain amount of the vertical loading.

A further significant advantage of the above system is that it permits the use of either steel or concrete diaphragm panels thus enabling one to utilize one or the other depending upon the relative cost and availability of these two materials.

Further features and advantages of the present invention will become apparent from the following description of preferred embodiments of same wherein reference is made to the drawings in which.

Figure 1:
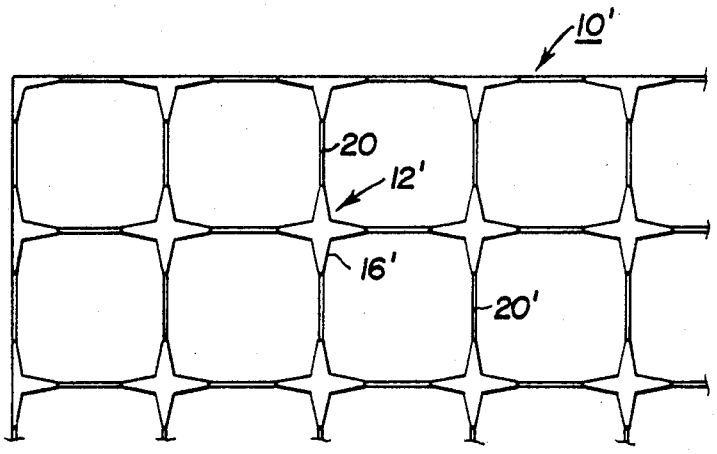
FIG. 1 is a somewhat diagrammatic plan view of the columns and their associated diaphragm panel structures for a square-cell silo system.
Figure 2:
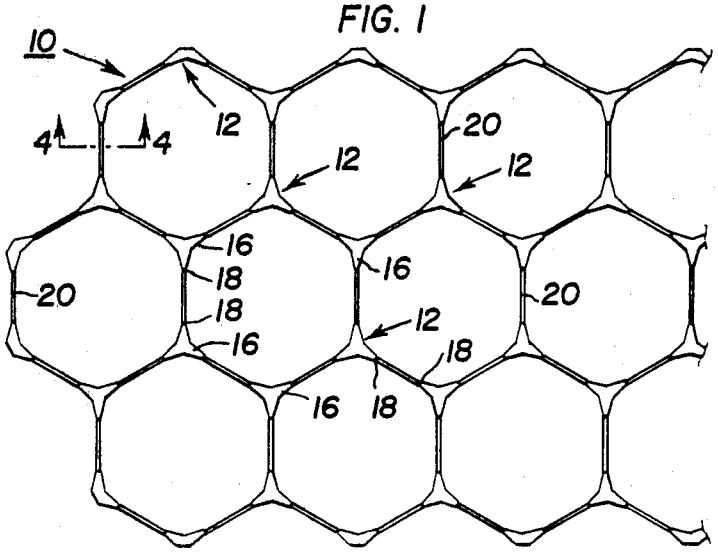
FIG. 2 is a view somewhat similar to that of FIG. 1 but illustrating a hexagon-cell layout.

With reference now to the drawings, there are shown in FIGS. 1 and 2 typical silo layouts for square-cell and hexagon-cell systems respectively. The silo construction as shown in FIG. 1 is designated by reference number 10' while the construction shown in FIG. 2 is designated by reference numeral 10. With reference particularly to FIG. 2, it will be seen that the silo 10 includes a plurality of spaced apart rigid vertical columns 12 supported by a foundation 14 (see FIG. 4). Each column 12 includes a plurality of integrally formed webs 16 radiating outwardly therefrom. Each web 16 extends in a direction toward a respective one of the webs 16 of the column 12 next adjacent thereto. By virtue of this arrangement each of the webs 16 of each column 12 is disposed in opposed spaced co-planar relationship with an associated one of the webs 16 of one of the next adjacent columns. Each of these webs terminates along a vertically disposed marginal edge 18 and it will readily seen from FIG. 2 that the marginal edges 18 of the associated co-planar web pairs are disposed in horizontally spaced apart relationship relative to one another.

The silo construction also includes a plurality of vertically disposed planar diaphragm panel structures 20 which serve to define the walls of the silo. Each diaphragm panel structure 20 extends between and is connected to the vertically disposed marginal edges 18 of each of the respective co-planar web pairs in generally co-planar relation therewith.

It will be seen hereinafter that the webs 16 of the columns and the associated diaphragm panel structures 20 are constructed and arranged to withstand the laterally directed forces applied thereto, in use, by the particulate materials stored in the cells of the silo. The means provided for transmitting vertically directed thrust components to columns 12 will also be described in further detail hereafter.

With further reference now to FIGS. 3–8, there is shown a silo construction wherein the walls of the silo are defined by diaphragm panels of reinforced concrete and designated by reference 20(*a*).

Figure 5:
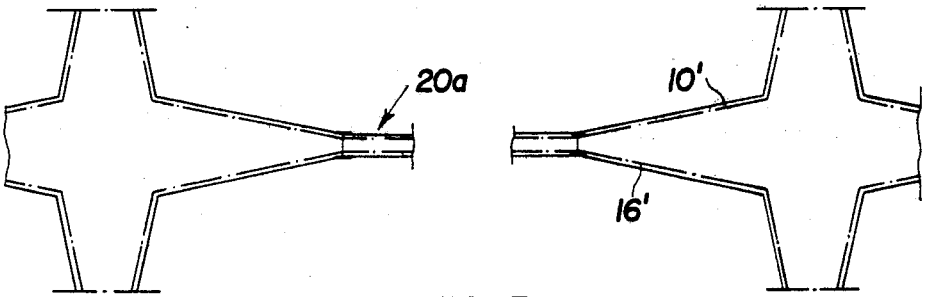
FIG. 5 is a partial sectional plan view for the square bin system.

The vertical columns 12 are each of reinforced concrete construction. As noted previously, each column 12 includes a plurality of integral webs 16 radiating outwardly therefrom. In the hexagonal cell system, each column includes three webs, the webs being disposed at an angle of 120° relative to each other. In the square-cell system as shown in FIGS. 1 and 5, the webs 16' are disposed at 90° angles to one another. In both cases it will be noted that the webs are of tapering cross-section, i.e., they are thickest at their root portions and then become progressively narrower toward their outwardly disposed marginal edges 18. This tapering configuration serves to assist in providing the webs 16 with adequate strength in the regions where strength is required to the greatest degree, i.e, adjacent the root portions of the webs.

Figure 6:
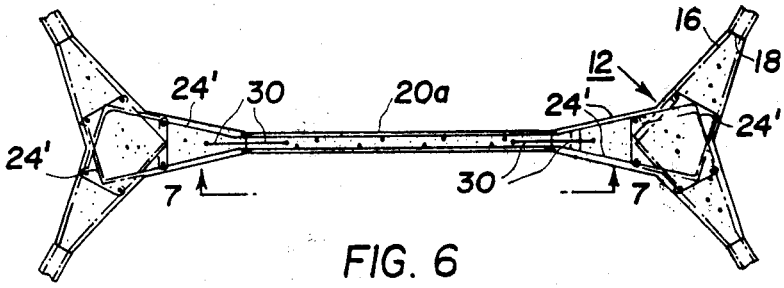
FIG. 6 is a partial plan view of a hexagonal bin system illustrating a pair of adjacent columns and a diaphragm panel of reinforced concrete construction extending between the same.
Figure 8:
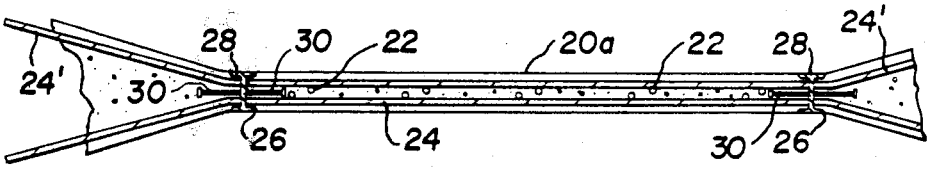
FIG. 8 is a cross-section view of the diaphragm panel taken along the line 8—8 in FIG. 7.

The diaphragm panel 20(*a*) is of a generally rectangular outline configuration. As best seen in FIG. 8, the panel includes sufficient steel reinforcement as to provide the panel with the necessary structural strength and rigidity. The panel includes vertically disposed sets of steel reinforcing rods 22 and horizontally extending sets of reinforcement rods 24, the opposing ends of rods 24 projecting a substantial distance outwardly beyond the opposing marginal edges 26 of the panel. The opposing marginal edges 26 of panel 20(*a*) are provided with I-beams 28 which extend therealong. The principal purpose of these I-beams 28 is to give added strength to the panel during the erection procedure. The I-beams 28 play only a minor part in the system once construction has been completed. The outwardly extending portions of rods 24 are designated by reference numerals 24'. These outwardly extending portions extend into the structure of the vertical columns 12 as best seen in FIG. 6. Thus these outwardly extending portions 24' serve not only to firmly secure the marginal edges 26 of the panel to the vertically disposed marginal edges 18 of the column webs but, in addition, help to provide the webs 16 with the necessary structural strength to withstand the bending moments encountered during use. Columns 12 are, of course, provided with such vertical reinforcing steel as is necessary under the circumstances.

Figure 4:
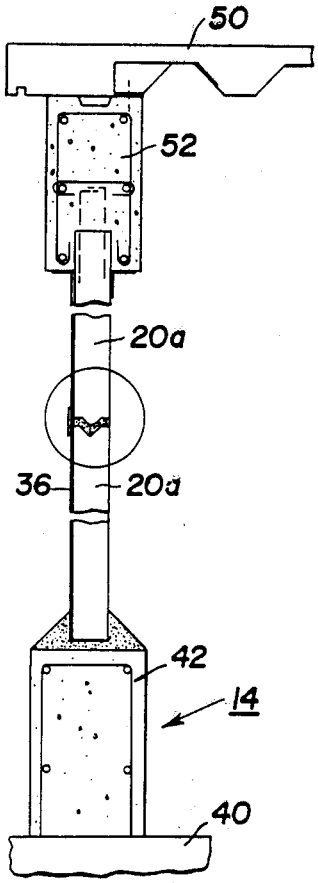
FIG. 4 is a vertical section view taken along line 4—4 in FIG. 2.
Figure 3:
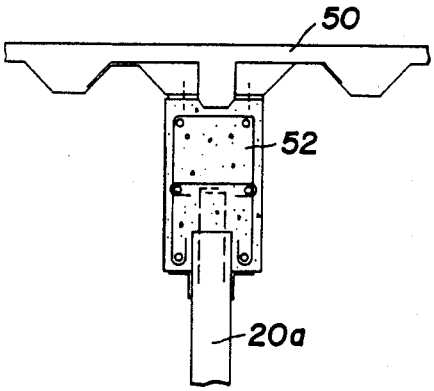
FIG. 3 is a fragmentary section view illustrating a typical top beam located just below the silo roof.
Figure 7:
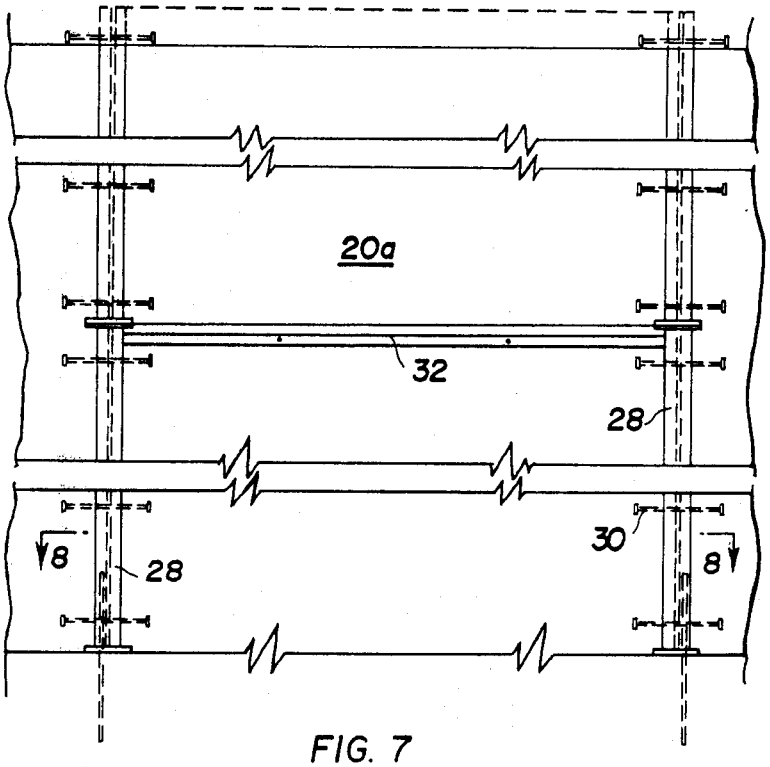
FIG. 7 is a side elevation view of a portion of the structure shown in FIG. 6 and looking in the direction of arrows 7—7 as shown in FIG. 6.

With reference to FIGS. 6, 7 and 8, it will be further noted that the I-beams 28 are provided with vertically spaced horizontally disposed shear connectors 30 which project in opposite directions away from the I-beams 28 and into the vertically disposed marginal edges of panel 20(*a*) as well as into the marginal edge portions 18 of the column webs which are in abutting relation with the marginal edges of the panel. These shear connectors 30 serve to provide an important function in that vertically directed force components applied to the panel 20(*a*) are transmitted via these shear connectors to the column webs with such vertical forces then passing downwardly via the columns 12 to the silo foundation. The number of shear connectors 30, and the size thereof are selected, in the preferred embodiment, such that all or virtually all of the vertically directed forces applied to the panels 20(*a*) are taken up by the shear connectors and transmitted to the columns. This means that the horizontal joints 32 between adjacent panels 20(*a*) may be of a relatively simple nature since they are not required to bear any vertical loadings. Typical joints between adjacent panels are illustrated in FIGS. 4(*a*) and 4(*b*). It will be noted that adjacent panels 20(*a*) are so arranged that a slight gap is provided therebetween with this gap then being filled with a suitable filler or caulking material (which, as seen from the above, does not have to withstand any vertical loading) thereby to prevent passage of the particulate material from one cell of the silo to another. The filler or caulking material is desirably of a flexible or deformable material, such as a rubber strip, thereby to accommodate any variations in the gap dimension which may occur during use of the silo by virtue of stress or temperature variations in the structure.

As was noted previously, in certain relatively low silo constructions where the vertical loadings encountered are relatively small, it may be possible to eliminate many of the shear connectors 30 and to allow a substantial portion of the vertical loadings to be taken up by the reinforced diaphragm panels 20(*a*). However, in most constructions, and certainly in all of the taller structures where the vertical forces encountered are substantial, it is highly desirable and indeed necessary to provide a sufficient number of shear connectors as to enable the vertical force components applied to the panels 20(*a*) to be transmitted by the shear connectors to the webs of the columns and thence carried down the columns to the foundation. In certain constructions the steel reinforcing rods alone may be sufficient to accommodate the shear forces involved, in which event separate shear connectors are not required.

Figure 4A:
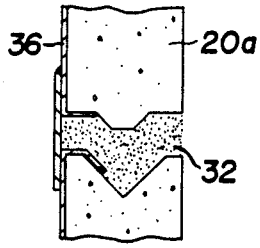
FIGS. 4A and 4B are fragmentary section views illustrating typical joints between adjacent diaphragm panels of reinforced concrete.
Figure 4B:
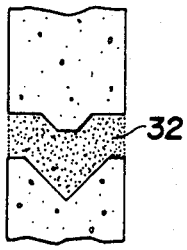

With reference to FIGS. 4 and 4A, it is further noted that the exteriorly disposed diaphragm panels 20(*a*) are provided with an inwardly facing metal cladding 36 thereby to prevent entry of water into the cells in the event that the concrete contains any hairline shrinkage cracks. The diaphragm panels which are fully interiorly disposed do not, of course, require any cladding of metal or of other materials.

With further reference to FIG. 4, the foundation for the silo is of a generally conventional nature. The foundation will generally include a horizontal pad or floor of concrete 40 with a short stub wall portion 42 extending upwardly therefrom a short distance and having outline configuration conforming to the outline configuration of the cell system in question.

At the top of the silo there is provided a suitable cap or roof structure 50. This is preferably of a reinforced concrete construction although any conventional roof system may be utilized. In order to provide additional strength to the overall structure, a reinforced beam arrangement 52 is interposed between the vertical columns and diaphragm panel system and the horizontally disposed roof arrangement 50. This particular beam system 52 is not absolutely necessary and may be modified at the discretion of the designer.

Figure 10:
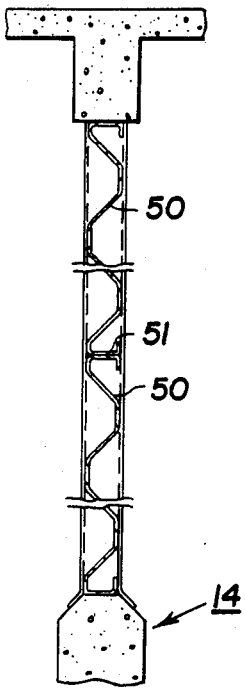
FIG. 10 is a vertical section taken along line 10—10 in FIG. 9 and illustrating particularly the configurations of the corrugations in the metal panel.
Figure 9:
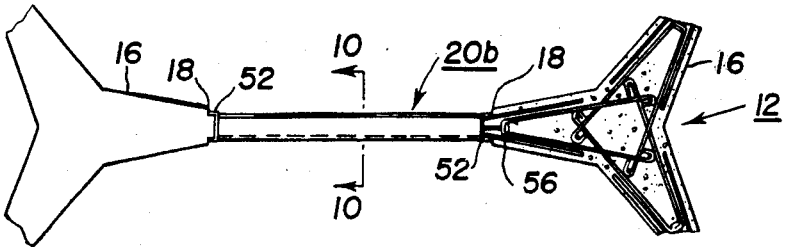
FIG. 9 is a view similar to FIG. 6 but illustrating the use of a metal diaphragm panel extending between the two columns.
Figure 11:
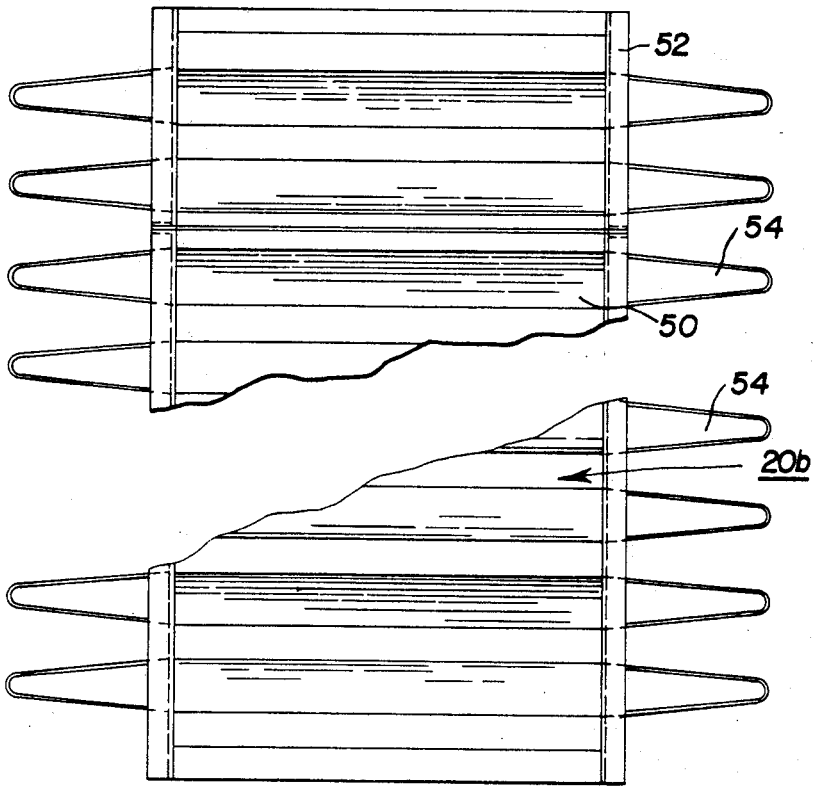
FIG. 11 is a side elevation view of a metal diaphragm panel further illustrating the corrugations formed therein as well as the anchors extending along opposing marginal edges thereof.

With reference now to FIGS. 9–11, there is shown an alternative form of diaphragm panel construction. This diaphragm panel, identified by reference No. 20(*b*), is constructed entirely of steel. In order to provide the panel with the necessary resistance to laterally directed forces, such panel 20(*b*) has a series of horizontally disposed undulations or corrugations 50 therein. The horizontal joints between adjacent panels are defined by flanged portions 51 which contact one another and are bolted together in any suitable manner. The vertically disposed marginal edges of such diaphragm panel are defined by steel channel sections 52 welded to the intermediate structure. In order to anchor the steel diaphragm panel 20(*b*) to the vertically disposed marginal edges 18 of the column webs 16, the opposite marginal edges of panel 20(*b*) are provided with a series of anchoring elements 54. These anchoring elements 54 extend a substantial distance into the webs 16 and serve to take up the various tension, bending forces, etc. encountered during use. In addition, since these metal panels are not capable of withstanding substantial vertical loadings, the marginal edges of same as defined by channel portions 52 are provided with outwardly directed vertically spaced apart shear connectors 56 which serve to transmit vertical thrust forces from the panel structures to the column webs 16, the latter being in abutting relation to the marginal edges of the panels 20(*b*). If desired, the shear connectors 56 may be replaced by relatively shallow shear lugs which are securely welded to the channel members 52 in such a way that the lugs project into the marginal edge portions of the column webs 16.

Figure 12A:
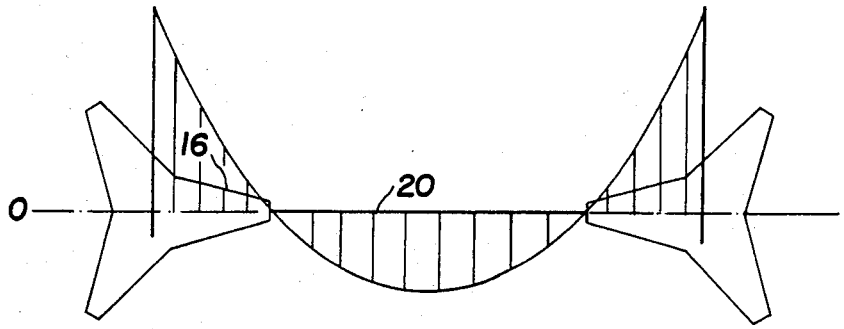
FIGS. 12A–12C illustrate typical bending moment diagrams.
Figure 12B:
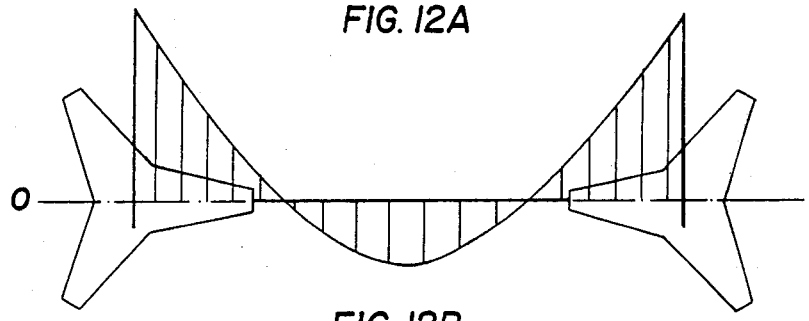
Figure 12C:
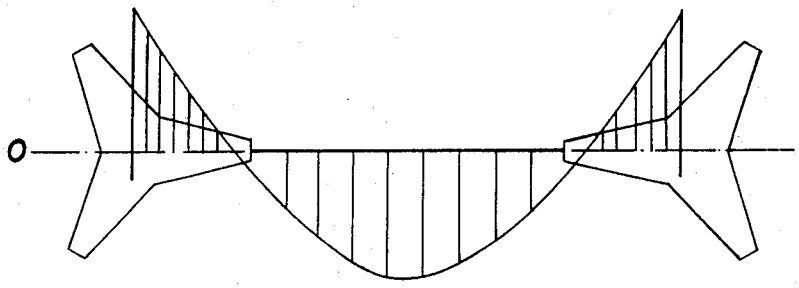

FIGS. 12A–12C illustrate the bending moment diagrams associated with various column and diaphragm panel constructions according to the present invention. It is, of course, appreciated that the webs 16 of the columns act along with the diaphragm panel structures 20 as beams designed to take lateral loadings. Thus the designer will select the effective length of the webs 16 in conjunction with the width of the diaphragm panels 20 to provide the most suitable ratio which ratio will largely be a question of economics, i.e., the relative cost of the diaphragm panels as compared with the cost of the reinforced concrete columns. The diagram shown in FIG. 12A would most commonly be associated with intermediate width panels coupled with average lateral loadings. The diagram of FIG. 12B would be associated with relatively strong diaphragm panels wherein relatively wide spans are involved together with relatively high lateral loadings. The diagram of FIG. 12C would normally be associated with somewhat lighter diaphragm panel constructions wherein relatively low lateral loadings are involved.

The sequence of steps involved in the erection of a silo structure according to the present invention will be largely apparent to those skilled in the art in the light of the above disclosure. The foundations will be constructed in accordance with conventional techniques. Then the diaphragm panels can be set up for a pair of adjacent columns which are to be poured and thereafter the form work for such columns is erected, the forms being connected along their marginal edges to the associated diaphragm panels. After all reinforcing steel has been placed in position the concrete may be poured. This procedure is repeated until the desired number of columns has been poured and their associated diaphragm panels secured in position. Generally speaking, the height of each diaphragm panel is selected to be within reasonable limits, e.g., somewhat less than 30 feet. So, therefore, in the first phase of the operation, the structure is brought to a height approximating the height of the diaphragm panels. The necessary staging is erected and the form work for the columns is moved upwardly and the next tier of diaphragm panels positioned in appropriate fashion relative to the form work for the associated columns, following which, after placement of all the necessary reinforcing rods, pouring of the columns is again proceeded with, this entire procedure being repeated over and over again as many times as are necessary to bring the entire silo to its desired overall height.

What is claimed is:

1. A silo having a plurality of vertically arranged cells for the storage of particulate materials, said silo comprising:

(a) a foundation;

(b) a plurality of spaced apart rigid vertical columns of reinforced cast-in-place concrete supported by said foundation;

(c) each column including a plurality of integral load bearing longitudinally extending webs radiating outwardly therefrom and being generally co-extensive therewith each web extending in a direction generally toward a respective one of the webs of the column next adjacent thereto, such that each of the webs of each column is disposed in opposed, horizontally spaced relationship with an associated one of the webs of one of the next adjacent columns thereby defining a plurality of web pairs;

(d) each such web terminating along a vertically disposed marginal edge;

(e) a plurality of vertically disposed diaphragm panel structures, each of which extends between the vertically disposed marginal edges of a respectively associated one of the web pairs each diaphragm panel structure comprising a plurality of panel sections in superposed spaced relation to one another;

(f) each diaphragm panel section having a pair of vertically directed marginal sides each of which is connected in abutting relation to an associated one of the vertically disposed marginal edges of the web pairs in such a manner that vertically directed thrust components applied to the diaphragm panel sections are transmitted laterally to the marginal edges of said load bearing webs so that the resulting vertical loadings are transmitted to the silo foundation via the vertical columns;

(g) the webs of the columns and the associated diaphragm panel sections being constructed and arranged to withstand laterally directed forces applied thereto, in use, by the materials stored in the silo;

(h) each diaphragm panel section including a plurality of laterally extending elements which project from its marginal sides into the associated webs of the reinforced concrete columns, said laterally extending elements being of a size and number such that substantially all of the vertically directed thrust components applied to the panel sections are taken up by the laterally extending elements and transmitted to the load bearing webs of the columns, said laterally extending elements being in load transmitting relation with one another to provide said connection and structural continuity between said webs and the panel sections and to assist in providing said webs with the necessary structural strength to withstand the stresses encountered during use; and (i) said columns being located in a pre-selected array such that said columns and the diaphragm panel sections associated therewith define an array of adjacent vertically arranged storage cells.

2. The silo according to claim 1 wherein each diaphragm panel section comprises a metal panel having generally horizontal corrugations therein to withstand said laterally directed forces encountered in use.

3. The silo according to any one of claims 1 or 2 wherein said columns, their integrally formed webs and the panel structures associated therewith are arranged to define an array of vertically arranged cells, said cells nesting with each other in the form of a honeycomb, any two adjacent cells being separated by a common web pair and their associated diaphragm panel structure.

4. The silo according to any one of claims 1 or 2 wherein said columns, their integrally formed webs and the associated panel structures are arranged in an array such as to define an array of closely adjacent cells, and wherein the cells are each of rectangular outline shape.

5. The silo according to any one of claims 1 or 2 wherein the webs of each pair are in generally co-planar relation with one another and with said diaphragm panel structures associated therewith.

6. The silo according to claim 1 wherein said spaced relation between the superposed panel sections is provided by generally horizontally disposed joints between adjacent panel sections.

7. The silo according to claim 6 wherein each diaphragm panel section comprises a slab of reinforced concrete, and a filler material in each said gap to prevent passage of particulate material therethrough.

8. In a silo for the storage of particulate materials, the combination of (a) a foundation;

(b) a plurality of spaced apart rigid vertical columns of reinforced cast-in-place concrete supported by said foundation;

(c) each column including a plurality of integral load bearing longitudinally extending webs radiating outwardly therefrom and being generally co-extensive therewith with each web extending in a direction generally toward a respective one of the webs of the column next adjacent thereto, such that each of the webs of each column is disposed in opposed, horizontally spaced relationship with an associated one of the webs of one of the next adjacent columns thereby defining a plurality of web pairs;

(d) each such web terminating along a vertically disposed marginal edge;

(e) a plurality of vertically disposed diaphragm panels, each of which extends between the vertically disposed marginal edges of an associated one of the web pairs;

(f) each diaphragm panel having a pair of vertically directed marginal sides each of which is connected in abutting relation to an associated one of the vertically disposed marginal edges of the web pairs in such a manner that vertically directed thrust components applied to the diaphragm panels are transmitted laterally to the marginal edges of said load bearing webs so that the resulting vertical loadings are transmitted to the silo foundation via the vertical columns;

(g) the webs of the columns and the associated diaphragm panels being constructed and arranged to withstand laterally directed forces applied thereto, in use, by the materials stored in the silo;

(h) each diaphragm panel including a plurality of laterally extending elements which project from its marginal sides into the associated webs of the reinforced concrete columns, said laterally extending elements being of a size and number such that substantially all of said vertically directed thrust components applied to the diaphragm panels are taken up by the laterally extending elements and transmitted to the load bearing webs of the columns, said laterally extending elements providing structural continuity between said webs and the diaphragm panels and assisting in providing said webs with the necessary structural strength to withstand the stresses encountered during use; and (i) horizontal joint means at least at the lower edges of said diaphragm panels defining gaps or spacing such that said joint means are not required to bear any substantial vertical loadings thereby to assist in ensuring that said vertical loadings are transmitted to said foundation by the vertical columns.

9. In a silo for the storage of particulate materials, the combination of (a) a foundation;

(b) a plurality of spaced apart rigid vertical columns of reinforced cast-in-place concrete supported by said foundation;

(c) each column including a plurality of integral load bearing longitudinally extending webs radiating outwardly therefrom and being generally co-extensive therewith with each web extending in a direction generally toward a respective one of the webs of the column next adjacent thereto, such that each of the webs of each column is disposed in opposed, horizontally spaced relationship with an associated one of the webs of one of the next adjacent columns thereby defining a plurality of web pairs;

(d) each such web terminating along a vertically disposed marginal edge;

(e) a plurality of vertically disposed diaphragm panels, each of which extends between the vertically disposed marginal edges of a respectively associated one of the web pairs;

(f) each diaphragm panel having a pair of vertically directed marginal sides each of which is connected in abutting relation to an associated one of the vertically disposed marginal edges of the web pairs in such a manner that vertically directed thrust components applied to the diaphragm panels are transmitted laterally to the marginal edges of said load bearing webs;

(g) the webs of the columns and the associated diaphragm panels being constructed and arranged to withstand laterally directed forces applied thereto, in use, by the materials stored in the silo;

(h) each diaphragm panel including a plurality of laterally extending elements which project from its marginal sides into the associated webs of the reinforced concrete columns, said laterally extending elements being of a size and number such that substantially all of said vertically directed thrust components applied to the diaphragm panels are taken up by the laterally extending elements and transferred to the load bearing webs of the columns and thereafter transmitted to the silo foundation via said columns, said laterally extending elements providing structural continuity between said webs and the diaphragm panels and assisting in providing said webs with the necessary structural strength to withstand the stresses encountered during use; and (i) generally horizontal joint means being associated with said diaphragm panels, with said panels being so arranged that there is no substantial transmission of vertical loading through said horizontal joint means thereby to assist in ensuring that substantially all of the vertical forces are carried down to the foundation via said columns.

* * * * *